US010320160B2

(12) United States Patent
Nishida et al.

(10) Patent No.: US 10,320,160 B2
(45) Date of Patent: Jun. 11, 2019

(54) ION GENERATION APPARATUS AND ELECTRICAL EQUIPMENT

(71) Applicant: Sharp Kabushiki Kaisha, Osaka-shi, Osaka (JP)

(72) Inventors: Hiromu Nishida, Osaka (JP); Nobuyuki Ohe, Osaka (JP); Koichi Izu, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 14/914,279

(22) PCT Filed: Aug. 27, 2014

(86) PCT No.: PCT/JP2014/072377
§ 371 (c)(1),
(2) Date: Feb. 25, 2016

(87) PCT Pub. No.: WO2015/151309
PCT Pub. Date: Oct. 8, 2015

(65) Prior Publication Data

US 2016/0204581 A1 Jul. 14, 2016

(30) Foreign Application Priority Data

Mar. 31, 2014 (JP) ..... 2014-072887

(51) Int. Cl.
*B03C 3/38* (2006.01)
*H01T 19/04* (2006.01)
(Continued)

(52) U.S. Cl.
CPC ..... *H01T 19/04* (2013.01); *B03C 3/38* (2013.01); *B03C 3/74* (2013.01); *B03C 3/743* (2013.01);
(Continued)

(58) Field of Classification Search
None
See application file for complete search history.

(56) References Cited

U.S. PATENT DOCUMENTS

2004/0145853 A1* 7/2004 Sekoguchi ..... A61L 9/22 361/225
2012/0068082 A1* 3/2012 Noda ..... H01T 23/00 250/423 R
(Continued)

FOREIGN PATENT DOCUMENTS

CN 2482752 Y 3/2002
CN 101640381 A 2/2010
(Continued)

OTHER PUBLICATIONS

Official Communication issued in International Patent Application No. PCT/JP2014/072377, dated Sep. 22, 2014.

*Primary Examiner* — Andrew Smyth
(74) *Attorney, Agent, or Firm* — Keating & Bennett, LLP

(57) ABSTRACT

An ion generation apparatus that can facilitate the separation of adhering materials from a discharge electrode and efficiently generate ions includes an induction electrode, and a discharge electrode for generating ions between the discharge electrode and the induction electrode. The discharge electrode has a plurality of filament-like conductors, and a joining portion to tie the bottoms of the conductors together. The induction electrode is arranged at the bottom side of the conductors.

7 Claims, 8 Drawing Sheets

(51) Int. Cl.
*H01T 23/00* (2006.01)
*B03C 3/74* (2006.01)
*B03C 3/41* (2006.01)

(52) U.S. Cl.
CPC ..... *H01T 23/00* (2013.01); *B03C 3/41* (2013.01); *B03C 2201/06* (2013.01)

(56) References Cited

U.S. PATENT DOCUMENTS

| | | | | |
|---|---|---|---|---|
| 2013/0120895 | A1 | 5/2013 | Lai | |
| 2013/0214173 | A1* | 8/2013 | Noda | H01T 23/00 250/423 R |
| 2014/0077701 | A1 | 3/2014 | Nishida | |

FOREIGN PATENT DOCUMENTS

| | | | | | |
|---|---|---|---|---|---|
| CN | 202651620 | U | | 1/2013 | |
| JP | 2000-340393 | A | | 12/2000 | |
| JP | 2000340393 | A | * | 12/2000 | |
| JP | 2000340393 | A | * | 12/2000 | |
| JP | 2003-229232 | A | | 8/2003 | |
| JP | 2003229232 | A | * | 8/2003 | |
| JP | 2003229232 | A | * | 8/2003 | |
| JP | 2004-342528 | A | | 12/2004 | |
| JP | 2004342528 | A | * | 12/2004 | |
| JP | 2004342528 | A | * | 12/2004 | |
| JP | 2008-034220 | A | | 2/2008 | |
| JP | 2008034220 | A | * | 2/2008 | |
| JP | 2008034220 | A | * | 2/2008 | |
| JP | 2012-038510 | A | | 2/2012 | |
| JP | 2012038510 | A | * | 2/2012 | |
| JP | 2012038510 | A | * | 2/2012 | |
| JP | 3174998 | U | | 4/2012 | |
| JP | 2012-243504 | A | | 12/2012 | |
| JP | 2012243504 | A | * | 12/2012 | H01T 19/04 |
| JP | 2012243504 | A | * | 12/2012 | H01T 19/04 |
| JP | 2013-011396 | A | | 1/2013 | |
| JP | 2013-041681 | A | | 2/2013 | |

* cited by examiner

ION GENERATION APPARATUS AND ELECTRICAL EQUIPMENT

TECHNICAL FIELD

The present invention relates to ion generation apparatuses and electrical equipment, and particularly to an ion generation apparatus including an induction electrode and a discharge electrode, and electrical equipment made using the ion generation apparatus.

BACKGROUND ART

Conventionally, an ion generation apparatus has been utilized to purify, sterilize or deodorize air in a room. Most ion generation apparatuses generate positive ions and negative ions by corona discharge.

Japanese Patent Laying-Open No. 2013-11396 (PTD 1) discloses a discharge unit including a discharge needle for effecting discharge, and a counter electrode arranged at a distance from the discharge needle, in which discharge occurs between the discharge needle and the counter electrode upon application of a voltage to the discharge needle. This discharge unit further includes a cleaning member to contact the discharge needle and remove adhering materials adhered to the tip end of the discharge needle.

CITATION LIST

Patent Document

PTD 1: Japanese Patent Laying-Open No. 2013-11396

SUMMARY OF INVENTION

Technical Problem

In an ion generation apparatus, corona discharge occurs between the tip end of a discharge electrode to which a high voltage has been applied and an induction electrode, so that ions are generated. When the ion generation apparatus is used in dirty air or a high humidity environment for extended periods of time, impurities such as dust in the air adhere to the tip end portion of the discharge electrode over time, resulting in a reduced amount of ions to be generated. Accordingly, there is a need to reduce the amount of materials adhering to the discharge electrode and to maintain the amount of ions to be generated in the ion generation apparatus.

The present invention was made in view of the above-described problem, and a main object of the invention is to provide an ion generation apparatus that can facilitate the separation of adhering materials from a discharge electrode and efficiently generate ions, and electrical equipment made using the ion generation apparatus.

Solution to Problem

An ion generation apparatus according to the present invention includes an induction electrode, and a discharge electrode for generating ions between the discharge electrode and the induction electrode. The discharge electrode has a plurality of filament-like conductors, and a joining portion to tie the bottoms of the conductors together. The induction electrode is arranged at the bottom side of the conductors.

Preferably, each of the conductors has an outer diameter of 5 μm or more and 30 μm or less. Preferably, the length of the conductors protruding from the joining portion is 3 mm or more.

Preferably, the ion generation apparatus further includes a cover member. The discharge electrode passes through a hole formed in the cover member and protrudes from the cover member. The length of the conductors protruding from the joining portion is less than or equal to half the length of the discharge electrode protruding from the cover member.

Preferably, the induction electrode has an annular shape surrounding the discharge electrode.

Preferably, the ion generation apparatus further includes an insulating material. The induction electrode is sealed with the insulating material. The discharge electrode protrudes from the insulating material. Preferably, the length of the conductors protruding from the joining portion is less than or equal to half the length of the discharge electrode protruding from the insulating material.

Electrical equipment according to the present invention includes the ion generation apparatus according to any one of the aspects described above, and an air blowing unit for delivering ions generated in the ion generation apparatus.

Advantageous Effects of Invention

According to the ion generation apparatus of the present invention, ions can be stably and efficiently generated.

DESCRIPTION OF EMBODIMENTS

Embodiments of the present invention will be described below with reference to the drawings. In the following drawings, the same or corresponding parts are designated by the same reference numbers, and will not be described repeatedly.

First Embodiment

Figure 1:
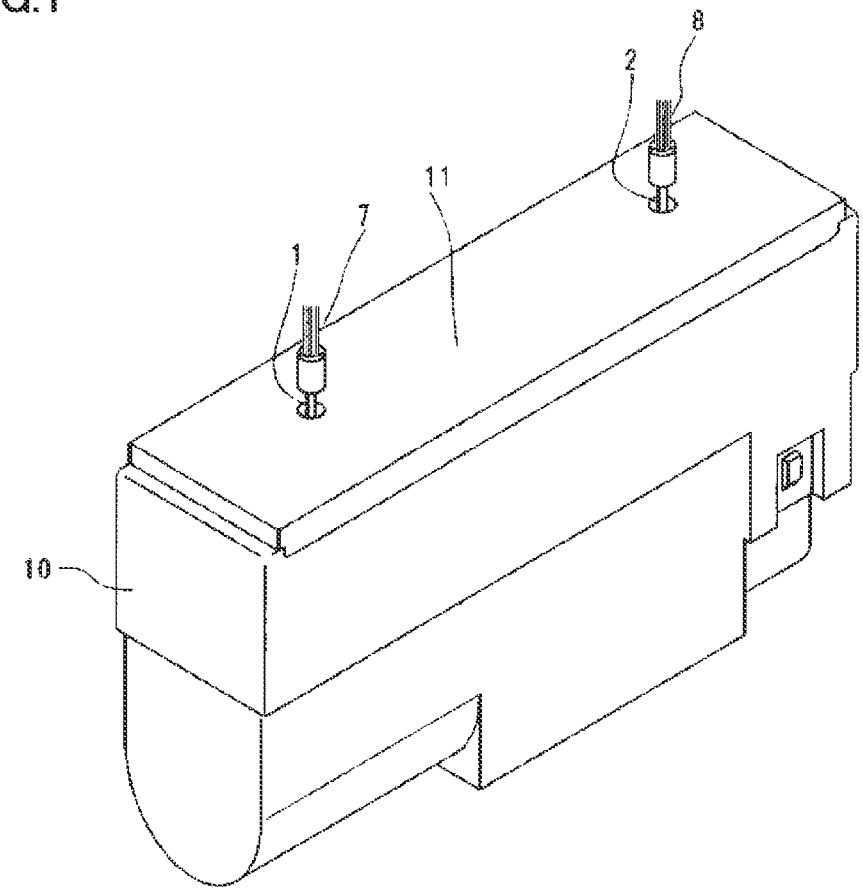
FIG. 1 is a perspective view showing an ion generation apparatus in a first embodiment of the present invention.
Figure 2:
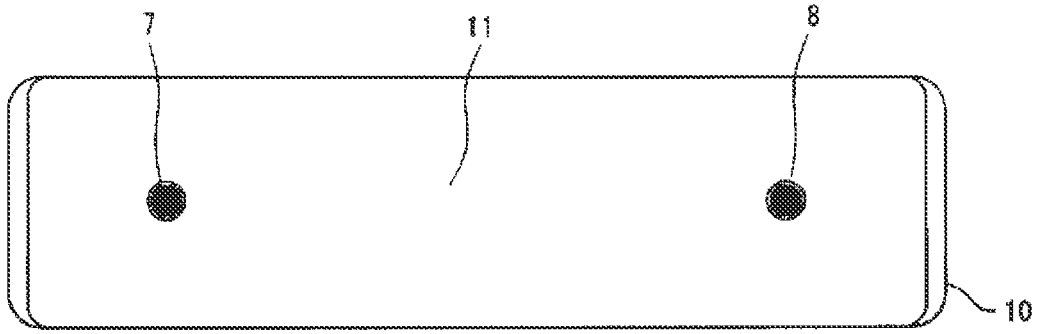
FIG. 2 is a plan view of the ion generation apparatus shown in FIG. 1.
Figure 3:
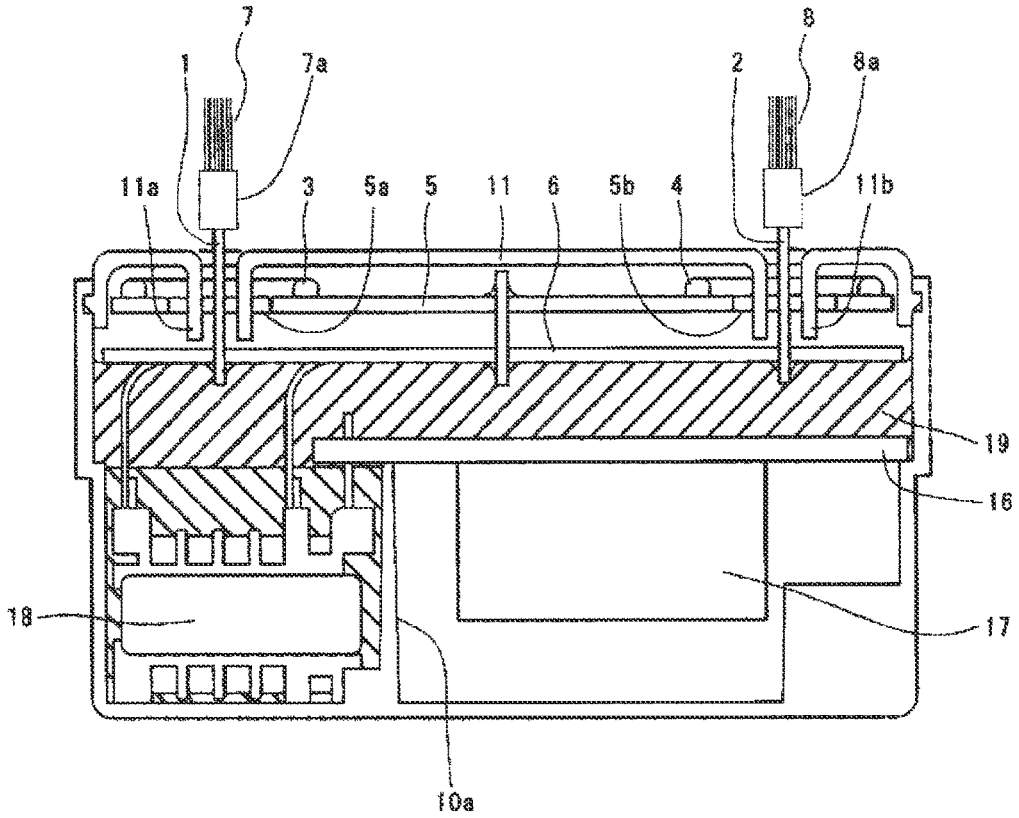
FIG. 3 is a cross-sectional view of the ion generation apparatus shown in FIG. 1.
Figure 4:
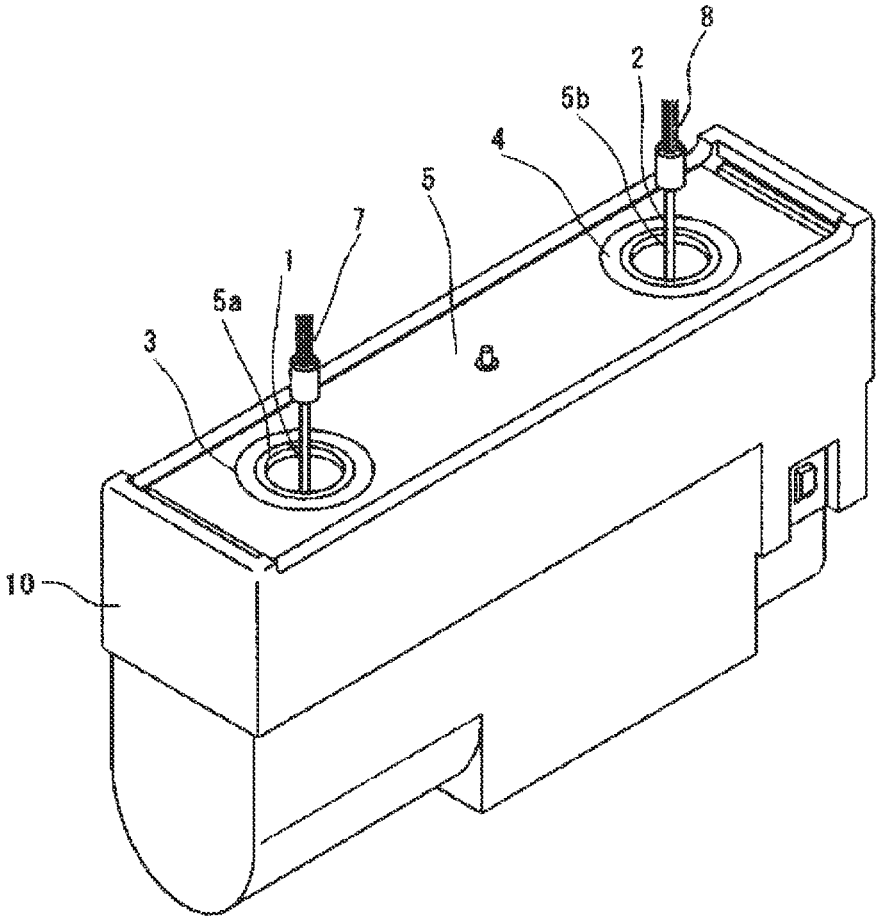
FIG. 4 is a perspective view showing the state where a cover member has been removed from the ion generation apparatus shown in FIG. 1.

FIG. 1 is a perspective view showing an ion generation apparatus in a first embodiment of the present invention. FIG. 2 is a plan view of the ion generation apparatus shown in FIG. 1. FIG. 3 is a cross-sectional view of the ion generation apparatus shown in FIG. 1. FIG. 4 is a perspective view showing the state where a cover member has been removed from the ion generation apparatus shown in FIG. 1. First, the structure of the ion generation apparatus of the first embodiment will be described in detail with reference to FIGS. 1 to 4.

The ion generation apparatus of the first embodiment includes two discharge electrodes 1 and 2, annular induction electrodes 3 and 4, and two print circuit boards 5 and 6 each formed in a rectangular shape. Induction electrode 3 serves as an electrode for forming an electric field between induction electrode 3 and discharge electrode 1. Induction electrode 4 serves as an electrode for forming an electric field between induction electrode 4 and discharge electrode 2. Discharge electrode 1 serves as an electrode for generating negative ions between discharge electrode 1 and induction electrode 3. Discharge electrode 2 serves as an electrode for generating positive ions between discharge electrode 2 and induction electrode 4.

Print circuit boards 5 and 6 are arranged at a prescribed distance in parallel with each other on the upper and lower sides as seen in FIG. 3. Induction electrode 3 is formed on the surface at one end portion of print circuit board 5 in the longitudinal direction using a wiring layer of print circuit board 5. Induction electrode 3 is provided inside with a hole 5*a* passing through print circuit board 5. Induction electrode 4 is formed on the surface at the other end portion of print circuit board 5 in the longitudinal direction using a wiring layer of print circuit board 5. Induction electrode 4 is provided inside with a hole 5*b* passing through print circuit board 5. Induction electrodes 3 and 4 are formed at low cost by using the wiring layers of print circuit board 5, whereby the manufacturing cost of the ion generation apparatus is reduced.

Each of discharge electrodes 1 and 2 is provided perpendicular to print circuit boards 5 and 6. Discharge electrode 1 has a base end portion that is inserted and fitted into a hole in print circuit board 6, and a tip end portion that passes through the center of hole 5*a* in print circuit board 5. Discharge electrode 2 has a base end portion that is inserted and fitted into a hole in print circuit board 6, and a tip end portion that passes through the center of hole 5*b* in print circuit board 5. The base end portion of each of discharge electrodes 1 and 2 is fixed to print circuit board 6 with solder.

Induction electrodes 3 and 4 are formed on print circuit board 5. Discharge electrodes 1 and 2 are fixed to print circuit board 6 different from print circuit board 5. Accordingly, even when the ion generation apparatus is placed in a high humidity environment in the state where dust accumulates on print circuit boards 5 and 6, current leakage between discharge electrode 1 and induction electrode 3 and between discharge electrode 2 and induction electrode 4 can be suppressed, so that ions can be stably generated.

The tip end portion of each of discharge electrodes 1 and 2 is made in the form of a brush. Discharge electrode 1 has a plurality of filament-like conductors 7 provided at its tip end portion, and a joining portion 7*a* to tie the bottoms of the plurality of conductors 7 together. Discharge electrode 2 has a plurality of filament-like conductors 8 provided at its tip end portion, and a joining portion 8*a* to tie the bottoms of the plurality of conductors 8 together.

Conductors 7 and 8 of discharge electrodes 1 and 2 are formed of a conductive material. Conductors 7 and 8 may be made of, for example, metal, carbon fiber, conductive fiber, or conductive resin. Each filament of conductors 7 and 8 has an outer diameter of 5 μm or more and 30 μm or less. By setting the thickness of each of conductors 7 and 8 at 5 μm or more, the mechanical strength of conductors 7 and 8 is secured while the electrical wear of conductors 7 and 8 is suppressed. By setting the thickness of each of conductors 7 and 8 at 30 μm or less, conductors 7 and 8 are formed so as to flex like hair, thus facilitating the spreading out and swinging of conductors 7 and 8 as will be described later in detail. Each of conductors 7 and 8 may be a carbon fiber having an outer diameter of 7 μm, or may be a conductive fiber made of SUS having an outer diameter of 12 μm or 25 μm.

If the length of conductors 7 and 8 protruding from joining portions 7*a* and 8*a* is too short, conductors 7 and 8 are less likely to flex and thus spread out and swing to a lesser extent, resulting in inability to sufficiently provide the effect of the ion generation apparatus of this embodiment. Accordingly, the length of conductors 7 and 8 protruding from joining portions 7*a* and 8*a* is set at 3 mm or more. Conductors 7 and 8 may protrude by 4.5 mm or more from joining portions 7*a* and 8*a*.

Furthermore, this ion generation apparatus includes a housing 10 formed in a rectangular parallelepiped shape and having a rectangular opening slightly larger than print circuit boards 5 and 6, a cover member 11 to close the opening in housing 10, a circuit substrate 16, a circuit component 17, and a transformer 18.

Housing 10 is formed of insulating resin. The lower portion of housing 10 is formed slightly smaller than the upper portion thereof, with a step formed on the inner wall of housing 10 at the boundary between the upper portion and lower portion of housing 10. In addition, the lower portion of housing 10 is divided into two sections in the longitudinal direction by a partition plate 10*a*. Transformer 18 is housed at the bottom on one side of partition plate 10*a*. Circuit substrate 16 is provided on partition plate 10*a* and the step so as to close the space on the other side of partition plate 10*a*. Circuit component 17 is mounted on a lower surface of circuit substrate 16, and is housed in the space on the other side of partition plate 10*a*.

Print circuit boards 5 and 6 are horizontally housed in the upper portion of housing 10. Circuit substrate 16, transformer 18, and print circuit boards 5 and 6 are electrically connected by wiring. A high voltage portion within housing 10 is filled with an insulating material 19 such as resin. Print circuit board 6 is filled to its lower surface with insulating material 19. In this embodiment, since circuit component 17 connected to the primary side of transformer 18 does not need to be insulated by insulating material 19, the space on the other side of partition plate 10*a* is not filled with insulating material 19.

Cover member 11 is formed of insulating resin. A groove is formed in an upper end portion of the inner wall of housing 10, while a locking portion to be inserted in the groove of housing 10 is provided to protrude from cover member 11 at its opposite ends in the longitudinal direction. With print circuit boards 5 and 6 being covered with cover member 11, accumulation of dust on print circuit boards 5 and 6 is suppressed.

A hollow cylindrical boss 11*a* is formed in a lower surface of cover member 11 at a position corresponding to hole 5*a* and discharge electrode 1. A hollow cylindrical boss 11*b* is formed in the lower surface of cover member 11 at a position corresponding to hole 5*b* and discharge electrode 2. Bosses 11*a* and 11*b* are formed to extend in the thickness direction of print circuit boards 5 and 6. Each of bosses 11*a* and 11*b* has an inner diameter greater than an outer diameter of each of discharge electrodes 1 and 2. Cover member 11 is provided, on the inner side of each of bosses 11*a* and 11*b*, a hole passing through cover member 11 in the thickness direction. Discharge electrodes 1 and 2 pass through bosses 11*a* and 11*b*, respectively. Discharge electrodes 1 and 2 pass through the holes formed in cover member 11, respectively, and protrude from cover member 11. Since conductors 7 and 8 at the tip end portions of discharge electrodes 1 and 2 protrude above cover member 11, even when dust accumulates on cover member 11, discharge can be prevented from being blocked by conductors 7 and 8 becoming buried in dust.

Each of bosses 11*a* and 11*b* has an outer diameter smaller than an inner diameter of each of holes 5*a* and 5*b* in print circuit board 5. Bosses 11*a* and 11*b* pass through holes 5*a* and 5*b* in print circuit board 5, respectively. A slight gap is formed between a tip end surface (lower end surface) of each of bosses 11*a* and 11*b* and the surface of print circuit board 6. By providing bosses 11*a* and 11*b*, the distance of space between discharge electrode 1 and induction electrode 3 and between discharge electrode 2 and induction electrode 4 is increased, so that current leakage between discharge electrode 1 and induction electrode 3 and between discharge electrode 2 and induction electrode 4 can be more effectively suppressed.

Figure 5:
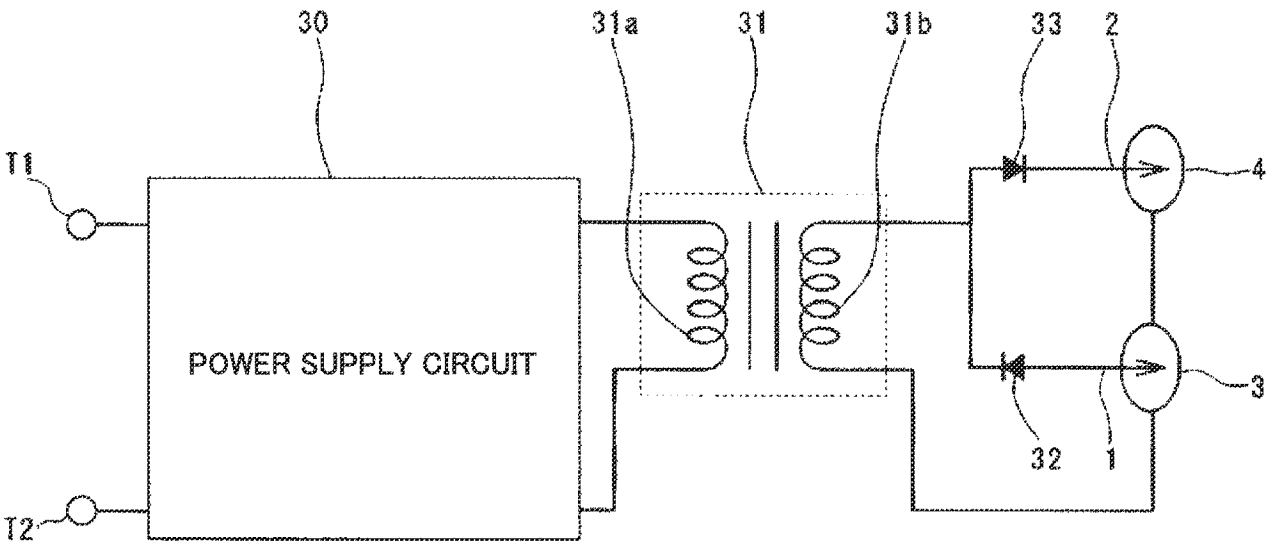
FIG. 5 is a circuit diagram showing the configuration of the ion generation apparatus shown in FIG. 1.

FIG. 5 is a circuit diagram showing the configuration of the ion generation apparatus shown in FIG. 1. Referring to FIG. 5, in addition to discharge electrodes 1, 2 and induction electrodes 3, 4, the ion generation apparatus includes a power supply terminal T1, a grounding terminal T2, diodes 32 and 33, and a boost transformer 31. A portion of the circuit shown in FIG. 5 other than discharge electrodes 1, 2 and induction electrodes 3, 4 is formed of circuit substrate 16, circuit component 17, transformer 18, and the like in FIG. 1. It is noted that the illustration of conductors 7 and 8 each made in the form of a brush and forming discharge electrode 1 is omitted in FIG. 5.

The positive electrode and the negative electrode of a direct-current (DC) power supply are connected to power supply terminal T1 and grounding terminal T2, respectively. Power supply terminal T1 is applied with a DC power supply voltage (for example, +12V or +15V) while grounding terminal T2 is grounded. Power supply terminal T1 and grounding terminal T2 are connected to boost transformer 31 through a power supply circuit 30.

Boost transformer 31 includes a primary winding 31*a* and a secondary winding 31*b*. Secondary winding 31*b* has one terminal connected to induction electrodes 3 and 4, and the other terminal connected to the anode of diode 32 and the cathode of diode 33. The cathode of diode 32 is connected to the base end portion of discharge electrode 1, and the anode of diode 33 is connected to the base end portion of discharge electrode 2.

The operation of this ion generation apparatus is now described. When a DC power supply voltage is applied between power supply terminal T1 and grounding terminal T2, electric charge is charged into a capacitor (not shown) included in power supply circuit 30. The electric charge charged into the capacitor is discharged through primary winding 31*a* of boost transformer 31, so that an impulse voltage is generated in primary winding 31*a*.

When an impulse voltage is generated in primary winding 31*a*, positive and negative high voltage pulses are alternately generated in secondary winding 31*b* while attenuating. The positive high voltage pulse is applied to discharge electrode 1 through diode 32 while the negative high voltage pulse is applied to discharge electrode 2 through diode 33. Thereby, corona discharge occurs at conductors 7 and 8 at the tip ends of discharge electrodes 1 and 2, thereby generating positive ions and negative ions, respectively.

It is noted that a positive ion is a cluster ion formed by a plurality of water molecules clustered around a hydrogen ion ($H^+$), and represented by $H^+(H_2O)_m$ (where m is any integer greater than or equal to 0). A negative ion is a cluster ion formed by a plurality of water molecules clustered around an oxygen ion ($O_2^-$) and represented by $O_2^-(H_2O)_n$ (where n is any integer greater than or equal to 0). When positive ions and negative ions are emitted into a room, both ions surround fungi, bacteria and viruses floating in the air, to cause a chemical reaction on their surfaces. Floating fungi, bacteria and the like are removed due to actions of hydroxyl radicals (.OH) that are active species and generated in this case.

Figure 6:
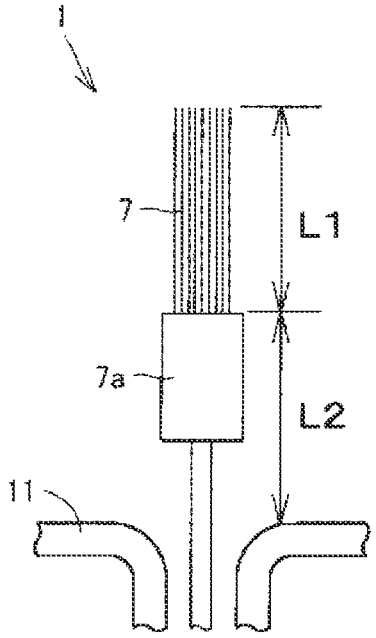
FIG. 6 is a diagram showing a ratio of brush length to protrusion length of a discharge electrode in the ion generation apparatus shown in FIG. 1.

FIG. 6 is a diagram showing a ratio of brush length to protrusion length of discharge electrode 1 in the ion generation apparatus shown in FIG. 1. Although discharge electrode 1 of two discharge electrodes 1 and 2 in the ion generation apparatus will be illustrated in FIG. 6 and FIGS. 7 and 8 which will be described later, discharge electrode 2 has a similar configuration to that of discharge electrode 1. A length L1 shown in FIG. 6 represents the length of each conductor 7 of discharge electrode 1 protruding from joining portion 7*a*, while a length L2 represents the length of joining portion 7*a* of discharge electrode 1 protruding from cover member 11.

In discharge electrode 1, the length of conductor 7 protruding from joining portion 7*a* is less than or equal to half the length of discharge electrode 1 protruding from cover member 11. The length of discharge electrode 1 protruding from cover member 11 is represented by a sum of length L1 and length L2 shown in FIG. 6, and length L1 representing the length of conductor 7 protruding from joining portion 7*a* is less than or equal to half the sum of length L1 and length L2. Length L1 representing the protrusion length of conductor 7 from joining portion 7*a* is less than length L2 representing the protrusion length of joining portion 7*a* from cover member 11. The length obtained by subtracting the brush length from the protrusion length of discharge electrode 1 from cover member 11 (length L2) is set to be greater than the brush length (length L1).

Figure 7:
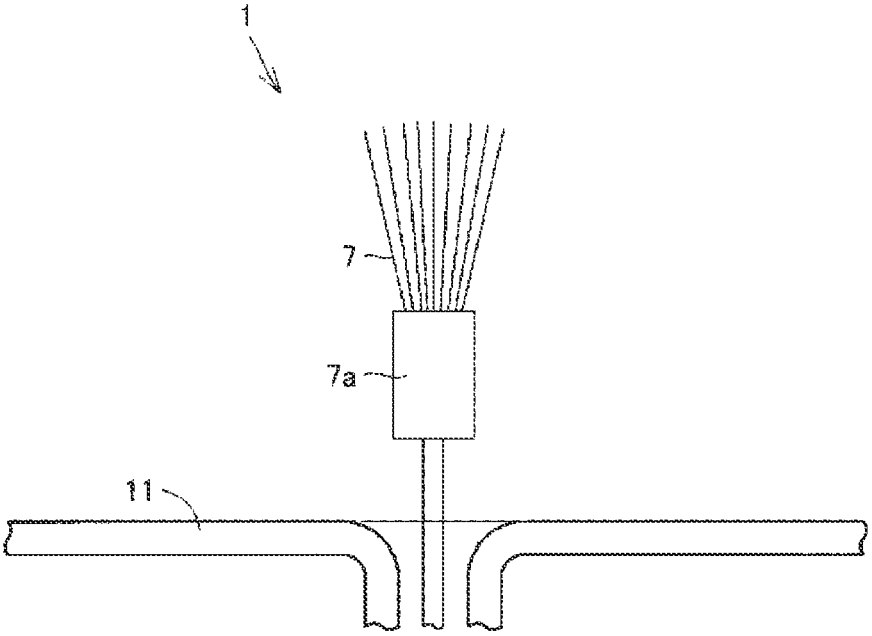
FIG. 7 is a diagram showing the state where the tip end portion of the brush has spread out upon passing a current through the ion generation apparatus shown in FIG. 1.

FIG. 7 is a diagram showing the state where the tip end portion of the brush has spread out upon passing a current through the ion generation apparatus shown in FIG. 1. Each of conductors 7 is made in the form of a small-diameter filament, and can flex like hair. When a high voltage pulse is applied to discharge electrode 1 through diode 32 (see FIG. 5), conductors 7 electrically repel one another as they are of the same polarity, thus forming a shape resembling a brush with a tip end spread out.

Figure 8:
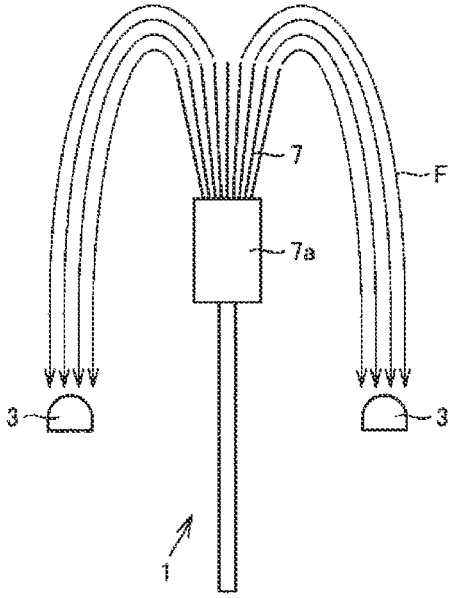
FIG. 8 is a diagram showing electric lines of force from the discharge electrode toward an induction electrode in the ion generation apparatus shown in FIG. 1.

FIG. 8 is a diagram showing electric lines of force F from discharge electrode 1 toward induction electrode 3 in the ion generation apparatus shown in FIG. 1. Induction electrode 3 is formed on the surface of print circuit board 5, and arranged at the bottom side of conductors 7 of discharge electrode 1. Electric lines of force F when a high voltage is applied to discharge electrode 1 follows a path from the tip ends of conductors 7 toward induction electrode 3, as indicated with arrows in FIG. 8. At this time, positive ions are generated at the tip ends of conductors 7. Since conductors 7 are bent and deformed due to the electrical repellency between conductors 7, the area of a region where the tip ends of conductors 7 exist increases. In the ion generation apparatus including discharge electrode 1 in the form of a brush, the area of a region where the ions are generated increases, whereby the amount of ions to be generated increases when the same voltage is applied, as compared to a needle-like discharge electrode.

Conductors 7 of discharge electrode 1 are electrically attracted to induction electrode 3 of the opposite polarity. One or a plurality of conductors 7 may bend significantly toward induction electrode 3. In the ion generation apparatus of this embodiment, by setting the dimensions of discharge electrode 1 as was described with reference to FIG. 6, conductor(s) 7 are prevented from contacting cover member 11 even when conductor(s) 7 are electrically attracted to induction electrode 3 and bent. Thus, the occurrence of abnormal discharge at a contact portion where conductors 7 are in contact with cover member 11, resulting in a problem of a reduced amount of ions to be generated or no generation of ions and a problem of an increased noise value of the ion generation apparatus are reliably avoided.

Second Embodiment

Figure 9:
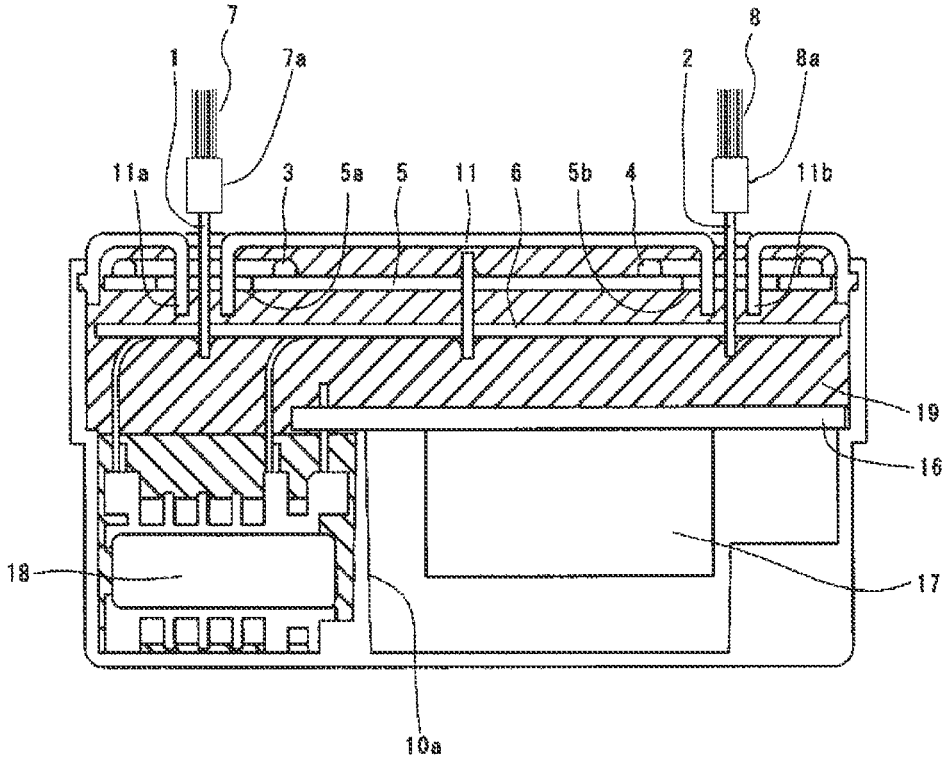
FIG. 9 is a cross-sectional view showing an ion generation apparatus in a second embodiment.

FIG. 9 is a cross-sectional view showing an ion generation apparatus in a second embodiment. In the ion generation apparatus of the first embodiment, print circuit board 6 is filled to its lower surface with insulating material 19. In contrast, in the ion generation apparatus of the second embodiment shown in FIG. 9, print circuit board 6 is also filled above its upper surface with insulating material 19. Cover member 11 is filled to its inner surface with insulating material 19. Induction electrodes 3 and 4 are sealed with insulating material 19, as shown in FIG. 9. Discharge electrodes 1 and 2 protrude from insulating material 19. Insulating material 19 electrically isolates discharge electrode 1 from induction electrode 3, and discharge electrode 2 from induction electrode 4.

Third Embodiment

Figure 10:
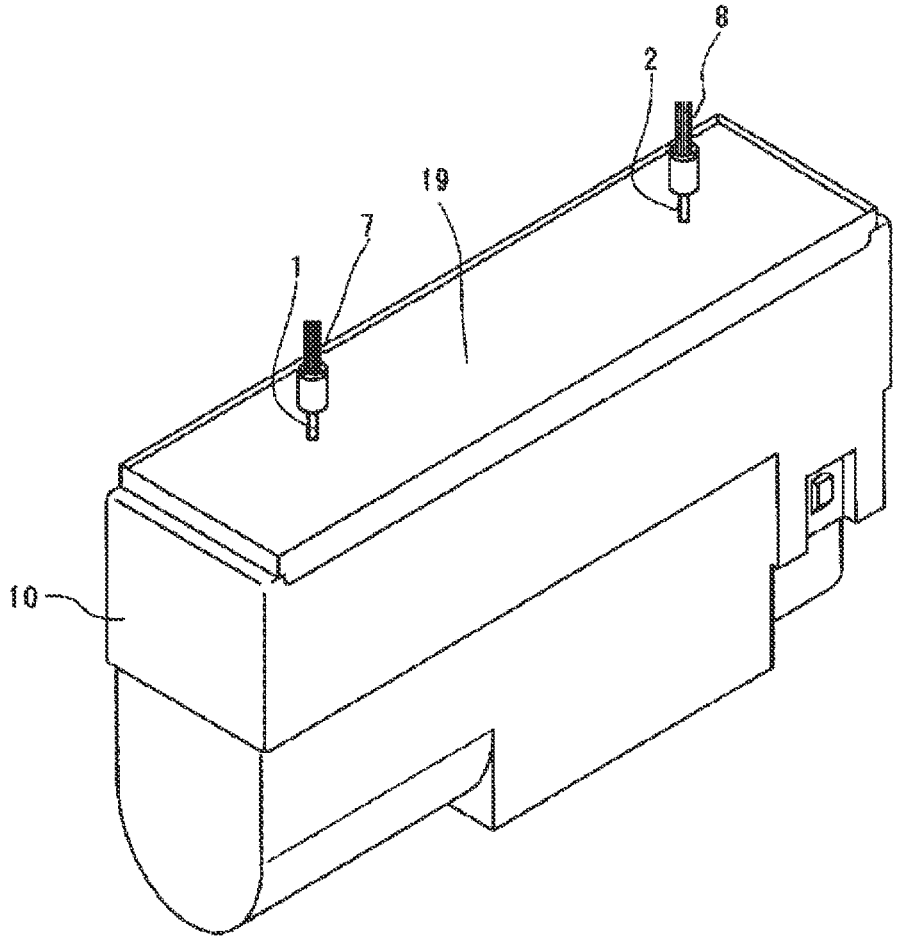
FIG. 10 is a perspective view showing an ion generation apparatus in a third embodiment.

FIG. 10 is a perspective view showing an ion generation apparatus in a third embodiment. The ion generation apparatus of the third embodiment includes, instead of cover member 11 described in the first embodiment, insulating material 19 such as epoxy resin or urethane resin. Induction electrodes 3 and 4 are sealed with insulating material 19. Discharge electrodes 1 and 2 protrude from insulating material 19. The length of conductors 7 of discharge electrode 1 protruding from joining portion 7*a* is less than or equal to half the length of discharge electrode 1 protruding from insulating material 19. The length of conductors 8 of discharge electrode 2 protruding from joining portion 8*a* is less than or equal to half the length of discharge electrode 2 protruding from insulating material 19. With insulating material 19 filling the space up to a position corresponding to the surface of cover member 11 in the first embodiment, insulating material 19 performs the function of electrically isolating discharge electrode 1 from induction electrode 3, and discharge electrode 2 from induction electrode 4.

When using cover member 11 provided with bosses 11*a* and 11*b* as described with reference to FIG. 3, it is difficult to pass filament-like conductors 7 and 8 through bosses 11*a* and 11*b* during attachment of cover member 11, and it is also difficult to perform cleaning in the case where foreign materials have entered cover member 11 through bosses 11*a* and 11*b*. By providing insulating material 19 instead of cover member 11, there is no need to pass conductors 7 and 8 through the bosses, so that the ion generation apparatus can be readily manufactured. Furthermore, cleaning can be readily performed even when dust has accumulated around discharge electrodes 1 and 2.

Figure 11:
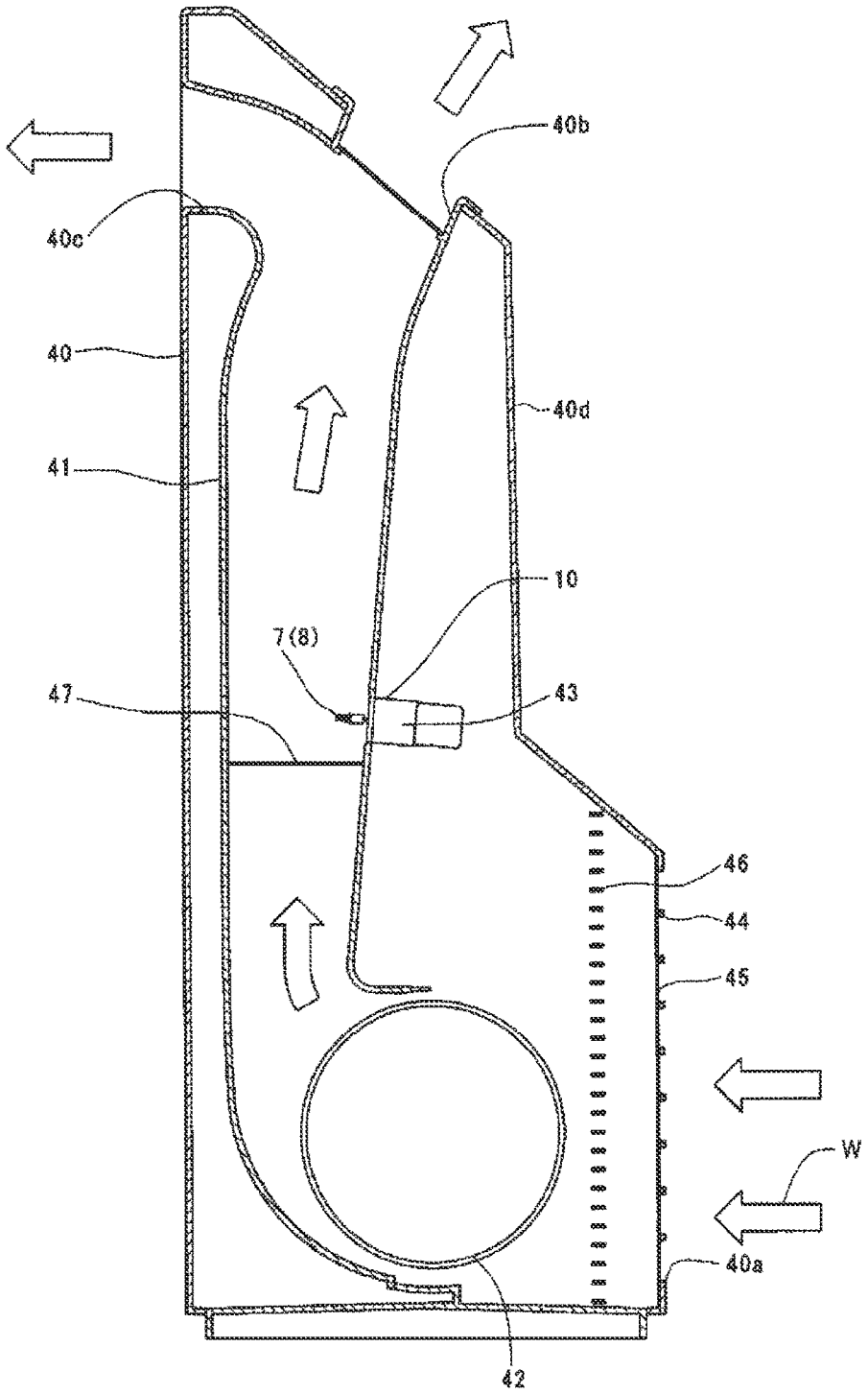
FIG. 11 is a cross-sectional view showing the configuration of an ion delivery apparatus made using the ion generation apparatus.

FIG. 11 is a cross-sectional view showing the configuration of an ion delivery apparatus made using the ion generation apparatus in one of the first to third embodiments. In FIG. 11, in this ion delivery apparatus, an inlet port 40*a* is provided in the rear surface at the lower portion of a main body 40, and outlet ports 40*b* and 40*c* are provided in the upper surface and front surface, respectively, at the upper portion of main body 40. Furthermore, a duct 41 is provided inside main body 40. The opening at the lower end of duct 41 is provided so as to face inlet port 40*a*. The upper end of duct 41 is connected to outlet ports 40*b* and 40*c*.

A cross flow fan 42 is provided as an air blowing fan in the opening at the lower end of duct 41, and an ion generation apparatus 43 is provided near the center of duct 41. Ion generation apparatus 43 is the same as that described in the first or second embodiment. Housing 10 of ion generation apparatus 43 is fixed to the outer wall surface of duct 41. Conductors 7 and 8 at the tip end portions of discharge electrodes 1 and 2 of ion generation apparatus 43 penetrate through the wall of duct 41 and protrude into duct 41. Conductors 7 and 8 of two discharge electrodes 1 are arranged in a direction orthogonal to a direction in which the air flows through duct 41.

Inlet port 40*a* is provided with a lattice-shaped grill 44 made of resin, and a mesh-like thin filter 45 is affixed to the inside of grill 44. A lattice-shaped fan guard 46 is provided on the inner side of filter 45 so as to prevent foreign materials and user's fingers from coming into cross flow fan 42. A fall prevention mesh 47 is provided in duct 41 slightly below the position where ion generation apparatus 43 is provided. When an object enters through outlet ports 40*b* and 40*c*, or when part of the components provided on duct 41 including ion generation apparatus 43 is partially fractured and falls, fall prevention mesh 47 catches the fallen object to prevent the object from getting caught in cross flow fan 42. Accordingly, the breakage or the like of cross flow fan 42 due to a fallen object is prevented from taking place.

When cross flow fan 42 is driven to rotate, the air in the room is suctioned through inlet port 40*a* into duct 41. The ions generated by ion generation apparatus 43 are emitted to the suctioned air in duct 41. The air, now including the ions, is emitted into the room through outlet ports 40*b* and 40*c*. A flow of the air generated by driving cross flow fan 42 is indicated with white arrows W in FIG. 11.

The air flowing through duct 41 by the rotation of cross flow fan 42 will directly hit conductors 7 and 8 in the form of a brush. Each filament of conductors 7 and 8 is in the form of a thin, long filament and flexes like hair, and thus swings by wind pressure of the air flowing through duct 41. Owing to the swinging of conductors 7 and 8, adhering materials such as dust that have electrically or physically adhered to the tip end of each filament of conductors 7 and 8 are shaken out of conductors 7 and 8. Furthermore, dust and the like will be less likely to adhere to conductors 7 and 8 owing to the swinging of conductors 7 and 8.

In a conventional ion generation apparatus, adhering materials such as dust adhere to the tip end portion of a needle-like electrode over time, which may result in a reduced amount of ions. In the ion generation apparatus of this embodiment, the materials adhering to conductors 7 and 8 forming the tip ends of discharge electrodes 1 and 2 can be reduced, so that the ions can be more efficiently generated.

While the adhesion of dust and the like to conductors 7 and 8 is significantly reduced by the swinging action of conductors 7 and 8, there are still adhering materials, so the user needs to remove the materials that have adhered to conductors 7 and 8 by cleaning. During the cleaning, the user can access ion generation apparatus 43 installed on duct 41 by removing a back cover 40*d* at the rear surface of main body 40 of the ion delivery apparatus. At this time, even if the user's finger touches conductors 7 and 8 protruding from housing 10, the user will not be injured, unlike a conventional ion generation apparatus employing a needle electrode, because conductors 7 and 8 are thin conductive fibers that flex like hair.

There are ion generation apparatuses that are not changed by the user. In that case, too, with ion generation apparatus 43 of the first embodiment, a worker's finger will not be injured even if the worker touches the tip end portions of conductors 7 and 8 during manufacture of the apparatus.

The configurations and a function and effect of the ion generation apparatus, and the ion delivery apparatus as an example of the electrical equipment of the embodiments will be summarized as follows. Although the components of the embodiments are designated by the reference numbers, they are exemplary only.

The ion generation apparatus according to this embodiment includes, as shown in FIG. 3, induction electrodes 3 and 4, and discharge electrodes 1 and 2 for generating ions between discharge electrodes 1 and 2 and induction electrodes 3 and 4. Discharge electrodes 1 and 2 have the plurality of filament-like conductors 7 and 8, and joining portions 7*a* and 8*a* to tie the bottoms of conductors 7 and 8 together. Induction electrodes 3 and 4 are arranged at the bottom side of conductors 7 and 8.

According to the ion generation apparatus having such a configuration, discharge electrodes 1 and 2 are formed by tying thin, filament-like conductors 7 and 8 together. Thus, each filament of the plurality of filament-like conductors 7 and 8 corresponds to one needle-like electrode of a conventional ion generation apparatus employing a needle-like electrode as a discharge electrode. Discharge occurs not in one location, but in locations corresponding to the number of conductors 7 and 8, thus increasing the locations of discharge. Accordingly, the amount of ions to be generated can be increased, so that the ions can be emitted more efficiently than a conventional ion generation apparatus employing a needle-like electrode as a discharge electrode.

Moreover, since each of conductors 7 and 8 is made in the form of a filament that readily flexes, when a high voltage is applied to discharge electrodes 1 and 2, the tip end portions of conductors 7 and 8 electrically repel one another, thus forming a shape resembling a brush with a tip end spread out as shown in FIG. 7. Accordingly, ions can be generated by discharge over a wide area as compared to a conventional ion generation apparatus employing a needle-like electrode, so that the ions can be efficiently generated.

Moreover, the tip end portions of conductors 7 and 8 can be spread out by applying a high voltage to discharge electrodes 1 and 2, and conductors 7 and 8 can be swung by forming an air flow around conductors 7 and 8. Thus, even when adhering materials such as dust have adhered to conductors 7 and 8, the adhering materials can be readily removed from conductors 7 and 8. By facilitating the separation of the adhering materials from discharge electrodes 1 and 2, the amount of materials adhering to discharge electrodes 1 and 2 can be reduced, so that the ions can be efficiently generated.

Moreover, even if the user touches the tip end portions of conductors 7 and 8 during manufacture or maintenance of the ion generation apparatus, an injury to the finger or the like can be prevented.

Preferably, each of conductors 7 and 8 has an outer diameter of 5 μm or more and 30 μm or less. By defining the outer diameter of each of conductors 7 and 8 as 5 or more, the mechanical strength of conductors 7 and 8 can be secured while the electrical wear of conductors 7 and 8 can be suppressed. By defining the outer diameter of each of conductors 7 and 8 as 30 μm or less, conductors 7 and 8 are formed so as to readily flex, thus facilitating the spreading out of conductors 7 and 8 upon application of a high voltage, and the swinging of conductors 7 and 8 upon formation of an air flow.

Preferably, the length of conductors 7 and 8 protruding from joining portions 7*a* and 8*a* is 3 mm or more. By defining the protrusion length of conductors 7 and 8 as 3 mm or more, conductors 7 and 8 are formed so as to readily flex, thus facilitating the spreading out of conductors 7 and 8 upon application of a high voltage, and the swinging of conductors 7 and 8 upon formation of an air flow.

Preferably, as shown in FIG. 3, the ion generation apparatus further includes cover member 11. Discharge electrodes 1 and 2 pass through the holes formed in cover member 11 and protrude from cover member 11. With conductors 7 and 8 protruding from housing 10 and cover member 11, the ions generated at the tip end portions of conductors 7 and 8 can be efficiently emitted to the outside of housing 10.

Preferably, as shown in FIG. 6, the length of conductors 7 and 8 protruding from joining portions 7*a* and 8*a* is less than or equal to half the length of discharge electrodes 1 and 2 protruding from cover member 11. Accordingly, conductors 7 and 8 are prevented from contacting cover member 11 even when conductors 7 and 8 are electrically attracted to induction electrodes 3 and 4 and bent upon application of a high voltage. Thus, the occurrence of abnormal discharge at a contact portion where conductors 7 are in contact with cover member 11 resulting in a problem of an increased noise value of the ion generation apparatus can be avoided.

Preferably, as shown in FIG. 4, each of induction electrodes 3 and 4 has an annular shape surrounding each of discharge electrodes 1 and 2. Accordingly, when a high voltage is applied to discharge electrodes 1 and 2, conductors 7 and 8 spread out 360° around the entire circumference toward induction electrodes 3 and 4 surrounding discharge electrodes 1 and 2. Thus, the area of a region where discharge occurs can be increased, so that the ions can be efficiently generated by discharge over a wider area.

Preferably, as shown in FIGS. 9 and 10, the ion generation apparatus further includes insulating material 19. Induction electrodes 3 and 4 are sealed with insulating material 19. Discharge electrodes 1 and 2 protrude from insulating material 19. Accordingly, insulating material 19 can electrically isolate discharge electrode 1 from induction electrode 3, and discharge electrode 2 from induction electrode 4. By providing insulating material 19 instead of cover member 11, there is no need to pass conductors 7 and 8 through the bosses, so that the ion generation apparatus can be readily manufactured. Furthermore, cleaning can be readily performed even when dust has accumulated around discharge electrodes 1 and 2.

Preferably, as shown in FIGS. 9 and 10, the length of conductors 7 and 8 protruding from joining portions 7*a* and 8*a* is less than or equal to half the length of discharge electrodes 1 and 2 protruding from insulating material 19. Accordingly, conductors 7 and 8 are prevented from contacting insulating material 19 even when conductors 7 and 8 are electrically attracted to induction electrodes 3 and 4 and bent upon application of a high voltage. Thus, the occurrence of abnormal discharge at a contact portion where conductors 7 are in contact with insulating material 19 resulting in a problem of an increased noise value of the ion generation apparatus can be avoided.

The ion delivery apparatus according to this embodiment includes, as shown in FIG. 11, ion generation apparatus 43 according to any one of the aspects described above, and cross flow fan 42 serving as an air blowing unit for delivering the ions generated by the ion generation apparatus. With discharge electrodes 1 and 2 of the ion generation apparatus protruding from housing 10, the air flowing through duct 41 by the rotation of cross flow fan 42 directly hits discharge electrodes 1 and 2, to deliver the ions generated around conductors 7 and 8 of discharge electrodes 1 and 2 to a downstream side of duct 41 through the air flow. In this manner, the ions generated around conductors 7 and 8 can be efficiently guided to the downstream side of duct 41 and emitted through outlet ports 40*b* and 40*c*.

When the air flowing through duct 41 directly hits conductors 7 and 8 in the form of a brush, conductors 7 and 8 swing. Accordingly, adhering materials such as dust that have electrically or physically adhered to the tip end of each filament of conductors 7 and 8 are shaken out of conductors 7 and 8. Furthermore, dust and the like will be less likely to adhere to conductors 7 and 8 owing to the swinging of conductors 7 and 8. By facilitating the separation of the adhering materials from discharge electrodes 1 and 2, the amount of materials adhering to discharge electrodes 1 and 2 can be reduced, so that the ions can be efficiently generated.

Although each of induction electrodes 3 and 4 is formed using a wiring layer of print circuit board 5 in this embodiment, each of induction electrodes 3 and 4 may be formed of a metal plate. Furthermore, each of induction electrodes 3 and 4 may not be formed in an annular shape.

Although an ion delivery apparatus has been illustrated as the electrical equipment made using ion generation apparatus 43 in this embodiment, ion generation apparatus 43 may be mounted on electrical equipment such as an air conditioner, a dehumidifier, a humidifier, an air purifier, a refrigerator, a gas fan heater, an oil fan heater, an electric fan heater, a washing and drying machine, a cleaner, a sterilization device, a microwave oven, or a copier.

It should be understood that the embodiments disclosed herein are illustrative and non-restrictive in every respect. The scope of the present invention is defined by the terms of the claims, rather than the description above, and is intended to include any modifications within the meaning and scope equivalent to the terms of the claims.

REFERENCE SIGNS LIST

1, 2 discharge electrode; 3, 4 induction electrode; 5, 6 print circuit board; 5*a*, 5*b* hole; 7, 8 conductor; 7*a*, 8*a* joining portion; 10 housing; 11 cover member; 11*a*, 11*b* boss; 16 circuit substrate; 17 circuit component; 18 transformer; 19 insulating material; 30 power supply circuit; 31 boost transformer; 40 main body; 41 duct; 42 cross flow fan; 43 ion generation apparatus; F electric line of force; L1, L2 length; T1 power supply terminal; T2 grounding terminal.

The invention claimed is:

1. An ion generator comprising:

an induction electrode;

a discharge electrode that generates ions between the discharge electrode and the induction electrode;

a first circuit board including a hole extending through the first circuit board;

a second circuit board arranged parallel to the first circuit board;

a housing that houses the first circuit board and the second circuit board; and an insulating resin that covers and is in contact with an upper surface and a lower surface of the first circuit board and an upper surface and a lower surface of the second circuit board, the first circuit board and the second circuit board being buried in the insulating resin, and the insulating resin electrically isolating the induction electrode from the discharge electrode; wherein the discharge electrode protrudes from the housing and includes a plurality of filament conductors;

the plurality of filament conductors protrude from the housing to an outside of the housing in a direction that is perpendicular to the first circuit board and the second circuit board, and protrude from a joining portion which joins bottoms of the conductors together;

the induction electrode is located at a bottom side of the conductors;

the insulating resin is uncovered such that the insulating resin is exposed to the outside of the housing;

the insulating resin is in contact with the induction electrode such that the induction electrode is sealed with the insulating resin;

the discharge electrode protrudes from the insulating resin;

lengths of the conductors protruding from the joining portion are less than or equal to half of a length of the discharge electrode protruding from the insulating resin;

the induction electrode is formed on the upper surface of the first circuit board; and the discharge electrode is fixed to the second circuit board and extends through a center of the hole in the first circuit board.

2. The ion generator according to claim 1, wherein each of the conductors has an outer diameter of 5 μm or more and 30 μm or less.

3. The ion generator according to claim 1, wherein the lengths of the conductors protruding from the joining portion are 3 mm or more.

4. The ion generator according to claim 1, wherein the induction electrode has an annular shape surrounding the discharge electrode.

5. The ion generator according to claim 1, wherein the insulating resin fills the housing.

6. Electrical equipment comprising:

the ion generator according to claim 1; and an air blower that delivers ions generated in the ion generator.

7. The ion generator according to claim 1, wherein a bottom portion of the discharge electrode is in contact with the insulating resin.

* * * * *